United States Patent [19]

Feldman

[11] 4,367,615

[45] Jan. 11, 1983

[54] REINFORCED INTERLOCKING BUILDING BLOCK

[76] Inventor: Louis Feldman, 1900 S. Palm Canyon Dr., Palm Springs, Calif. 92262

[21] Appl. No.: 185,447

[22] Filed: Sep. 9, 1980

[51] Int. Cl.[3] ..... E04C 1/10

[52] U.S. Cl. ..... 52/583; 52/594

[58] Field of Search ..... 52/583, 606, 587, 594, 52/601

[56] References Cited

U.S. PATENT DOCUMENTS

| | | | |
|---|---|---|---|
| 1,356,347 | 10/1920 | Evans | 52/587 |
| 1,369,115 | 2/1921 | Kline | 52/587 |
| 1,558,801 | 10/1925 | Frey | 52/587 |
| 1,624,369 | 4/1927 | Serra | 52/587 X |
| 1,834,842 | 12/1931 | Houghtaling | 52/587 X |
| 2,142,305 | 1/1939 | Davis | 52/601 X |
| 2,296,699 | 9/1942 | Bourdelais, Sr. et al. | 52/582 |
| 2,338,246 | 1/1944 | Hoye | 52/601 |
| 2,635,450 | 4/1953 | Orzel | 52/583 |

*Primary Examiner*—John E. Murtagh
*Assistant Examiner*—Carl D. Friedman
*Attorney, Agent, or Firm*—Duffield & Lehrer

[57] ABSTRACT

A substantially rectangularly shaped block of cementitious material has a metal reinforcing member extending there through and embedded therein. The reinforcing member has a height substantially equal to the height of the block and extends past one end of the block, terminating in an elongated T-shaped tongue. Adjacent the other end of the block, the reinforcing member terminates in an elongated groove, slightly larger than but complementary to the shape of the tongue. In use, adjacent blocks are loosely but securely locked together by the cooperating tongues and grooves of the reinforcing members of the adjoining building blocks.

4 Claims, 8 Drawing Figures

REINFORCED INTERLOCKING BUILDING BLOCK

BACKGROUND OF THE INVENTION

The present invention is directed toward an interlocking reinforced building block and more particularly toward a reinforced interlocking building block which includes a metal reinforcing member embedded within the block which has a tongue and groove at either end thereof for loosely but securely joining adjacent blocks.

Interlocking blocks have been known for some time. Examples of such blocks are shown in U.S. Pat. Nos. 1,684,050; 1,833,098; 2,296,699 and numerous others. In most cases, a wall or similar structure constructed from such interlocking blocks is somewhat stronger than a wall built of ordinary blocks. However, if the wall is subject to severe vibration such as may be caused by an earthquake or tremor, the tongues and grooves of the blocks can easily break thereby seriously weakening the wall. U.S. Pat. No. 2,296,699 suggests the use of internal wire reinforcing members for strengthening the blocks. While this may provide some additional strength, the interlocking tongues and grooves can still break since they are primarily made of a cementitious material.

To Applicant's knowledge, only one attempt has been made to construct a block incorporating reinforcing members wherein the reinforcing members also function to join adjacent blocks. This is shown in U.S. Pat. No. 1,369,115. However, the reinforcing members shown in this patent provides very little, if any, actual reinforcement. Furthermore, the interlock between the blocks is very tight allowing no movement whatsoever. This very tight fit makes the assembly and construction of a wall of blocks much more difficult. Furthermore, once each block is positioned in place, no means are provided for preventing vertical displacement of the block.

SUMMARY OF THE INVENTION

The present invention overcomes the problems of the prior art and provides a building block which is easy to work with and which will provide a construction which should withstand vibrations such as provided by earthquakes and the like far better than existing blocks. The building block of the present invention is comprised of a substantially rectangularly shaped block of cementitious material which has a metal reinforcing member extending there through and embedded therein. The reinforcing member has a height substantially equal to the height of the block and extends past one end of the block, terminating in an elongated T-shaped tongue. Adjacent the other end of the block, the reinforcing member terminates in an elongated groove, slightly larger than but complementary to the shape of the tongue. In use, adjacent blocks are loosely but securely locked together by the cooperating tongues and grooves of the reinforcing members of the adjoining building blocks.

BRIEF DESCRIPTION OF THE DRAWING

For the purpose of illustrating the invention, there is shown in the accompanying drawing one form which is presently preferred; it being understood that the invention is not intended to be limited to the precise arrangements and instrumentalities shown.

FIG. 8 is a perspective view showing the manner in which building blocks of the present invention may be utilized with conventional door and/or window openings or the like.

DETAILED DESCRIPTION OF THE PREFERRED EMBODIMENT

Figure 2:
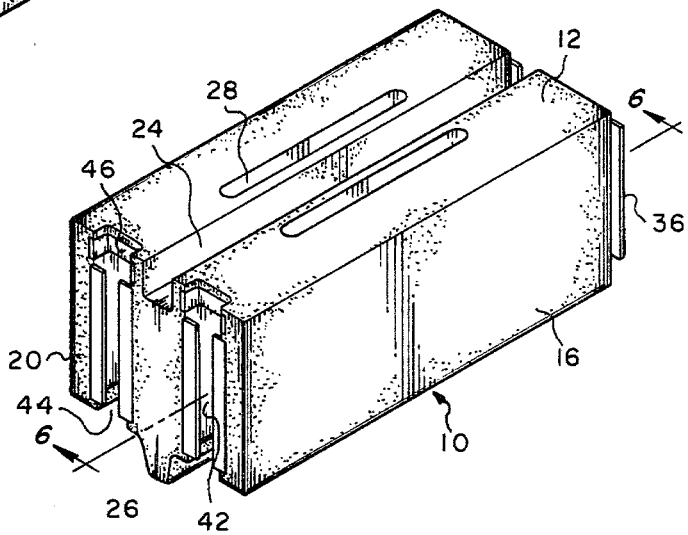
FIG. 2 is a top perspective view of one of the blocks shown in FIG. 1.

Referring now to the drawing in detail wherein like reference numerals have been used throughout the various figures to designate like elements, there is shown in FIG. 2 a top perspective view of a reinforced interlocking building block constructed in accordance with the principles of the present invention and designated generally as 10. As can be seen from the drawing, the block 10 has the same general overall appearance as a conventional masonry block. With the exception of the reinforcing member, described hereinbelow, the block 10 is preferably made entirely from cementitious material.

Figure 1:
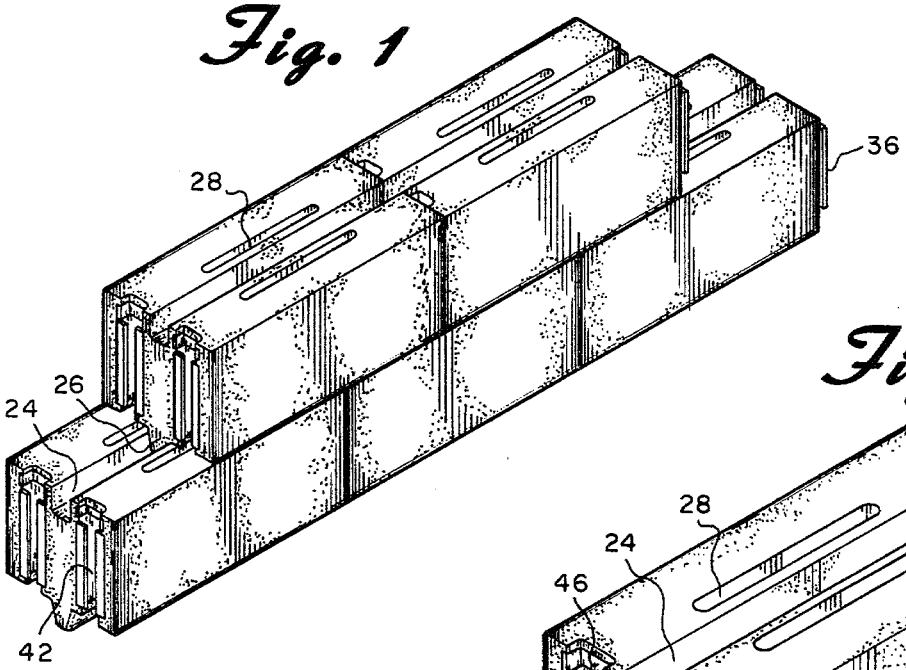
FIG. 1 is a perspective view of a portion of a wall built utilizing blocks constructed in accordance with the principles of the present invention.

The reinforced interlocking block 10 is substantially rectangularly shaped and includes a top wall 12, bottom wall 14, right side wall 16, left side wall 18, front end wall 20 and rear end wall 22. Formed in the center of the top wall 12 and extending the entire length of the block is a recess 24. A complementary projection 26 is located on the bottom wall 14 and also extends the entire length of the block. As shown most clearly in FIG. 1, the projection 26 of the block in one course of blocks extends into the recess 24 in the lower course so as to help maintain the blocks in alignment.

One or more elongated holes 28 pass through the block 10 in the vertical direction. In the preferred embodiment, two such holes are provided. These holes both lighten the blocks and provide means for further maintaining a plurality of vertical blocks in alignment. As is well known in the art, this is accomplished by either pouring mortar down through the holes in a plurality of vertically arranged blocks and/or by inserting a length of reinforcing bar there through.

Figure 5:
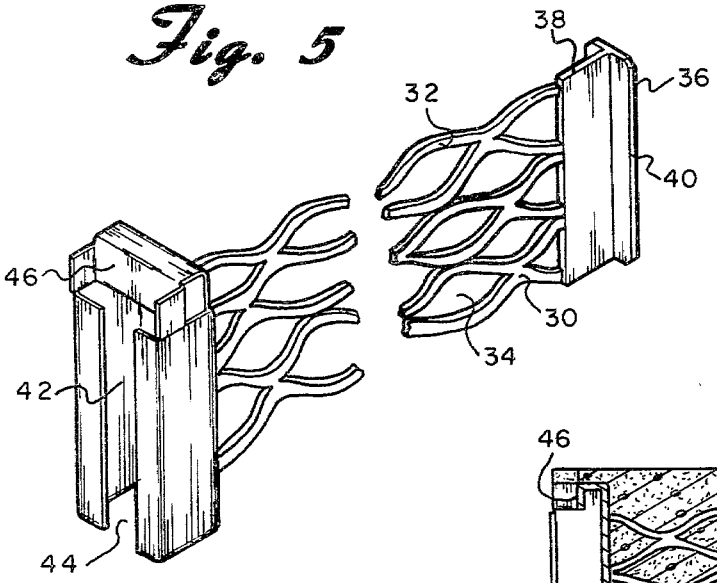
FIG. 5 is a perspective view of the internal reinforcing structure utilized with the present invention.
Figure 6:
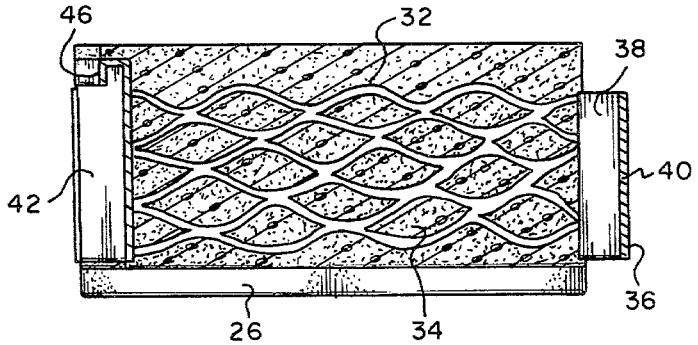
FIG. 6 is a cross-sectional view taken through the line 6—6 of FIG. 2.

Embedded within the cementitious block are a pair of reinforcing members shown most clearly in FIGS. 5 and 6. The reinforcing member 30 is preferably made of metal and has a height which is substantially the same as the height of the block itself. The length of the reinforcing member 30 is slightly longer than the length of the block of cementitious material.

The reinforcing member 30 is comprised essentially of three parts. The central portion 32 is constructed of wire mesh material and thus has a plurality of openings 34 there through. It is the wire mesh portion 32 and particularly the openings 34 which allow the reinforcing member 30 to be securely held in place within the cementitious block. As the block is being molded, the reinforcing member or members 30 are placed in the mold and the cementitious material passes through the openings 34 and, therefore, securely holds the reinforcing members 30 in place when the cementitious material hardens (see, for example, FIG. 6).

Located at one end of the reinforcing member 30 is an elongated, headed tongue 36 of substantially T-cross section. Thus, the tongue 36 has a first element 38 which is parallel to the wire mesh portion 32 of the reinforcing member 30 and a second element 40 which is transverse to the element 38.

The other end of the reinforcing member 30 includes a "groove" 42. Groove 42 is comprised essentially of an elongated tubularly shaped metallic member having an opening or slot 44 formed therein on the side of the tube opposite the wire mesh 32. The slot 44 runs the entire height of the tubular member and has a width which is slightly greater than the thickness of the section 38 of the T-shaped tongue 36. Similarly, the width of the section 40 of the T-shaped tongue 36 is slightly smaller than the width of the interior of the tubular member of the groove 42. As a result, the tongue from one reinforcing member 30 can be slid vertically down into the groove 42 of an adjacent reinforcing member with the transverse portion 40 of the T-shaped tongue 36 fitting within the groove and the longitudinal portion 38 fitting within the slot 44.

For the reasons which will become more apparent hereinafter, the opening at the top of the groove 42 is preferably smaller than the opening at the bottom and the remaining cross-sectional area of the interior of the groove. This is accomplished by providing a partial wall 46 at the upper end thereof. Wall 46 may be constructed by cutting and then bending the sheet metal which forms the groove 42 across and downwardly as shown most clearly in FIG. 6.

Figure 3:
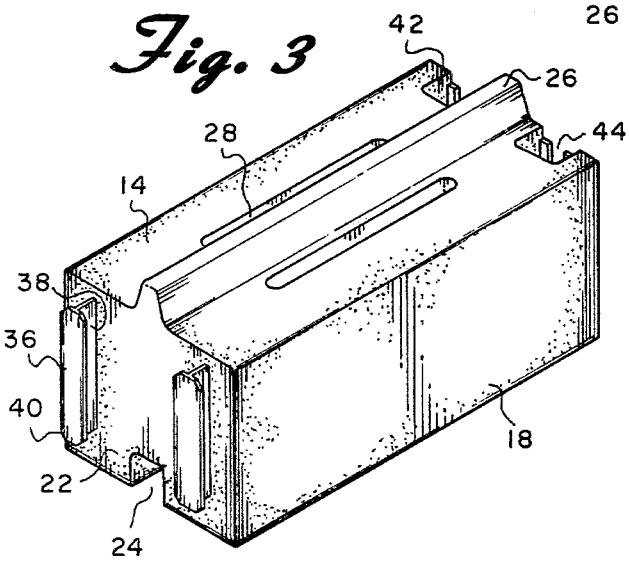
FIG. 3 is a bottom perspective view of the block shown in FIG. 2.

As shown most clearly in FIGS. 2, 3 and 6, when the block 10 is formed, the T-shaped tongue 36 of the reinforcing member 30 extends outwardly past the end wall 22. On the other hand, the end of the channel member forming the groove 42 is flush with the other end wall 20. When viewing the finished block, it appears to be constructed totally of cementitious material except for the tongue 36 extending from one end thereof and the parts of the groove 42 which can be seen from the end 20 of the block.

Figure 4:
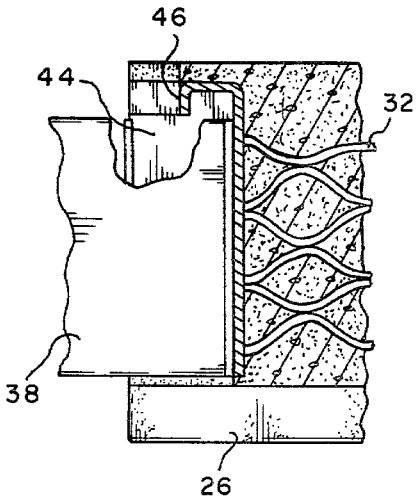
FIG. 4 is a cross-sectional view showing the coupling between adjacent blocks of FIG. 1.

During assembly, the blocks are set with mortar in the conventional manner. A second block interlocks with a first block by raising the second block and sliding the forward portion 40 of the tongue downwardly into the groove 42 of the first block. When the blocks are in vertical alignment, the second block is pushed toward the first block so that the end walls meet (with mortar placed there between). In this position, the forward end of the T-shaped tongue 36 is beneath the partial top wall 46 of the groove in the next block as shown in FIG. 4. This partial wall 46 prevents upward movement of the tongue and therefore the block and also prevents mortar from falling downwardly and filling the groove.

Figure 7:
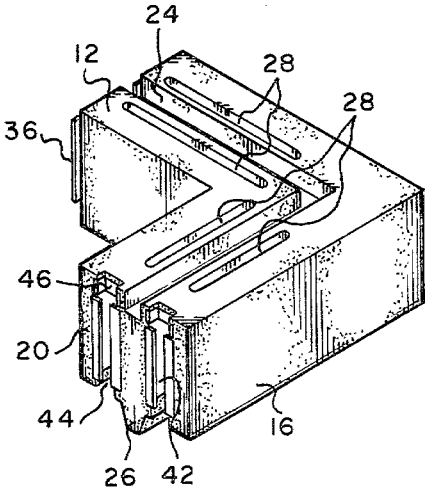
FIG. 7 is a perspective view of a corner block.

While the majority of blocks needed during any particular construction will normally be of the kind shown in FIGS. 2 and 3, occasionally, particularly shaped blocks may be needed. For example, FIG. 7 shows a corner block which is constructed in substantially the same manner as the block 10 but with the tongue and groove portions at right angles to each other. In lieu of the corner block, it would also be possible to miter the ends of the blocks which will be meeting at a corner. That is, one end of a block such as the block shown in FIG. 2 would be identical to the block shown therein but the other end of the block would have a face which is at a 45° angle to the face shown on block 10. A complementarily shaped block will meet with this block so as to form a corner. Other types of blocks for other special situations are also possible and are well within the scope of those skilled in the art.

Figure 8:
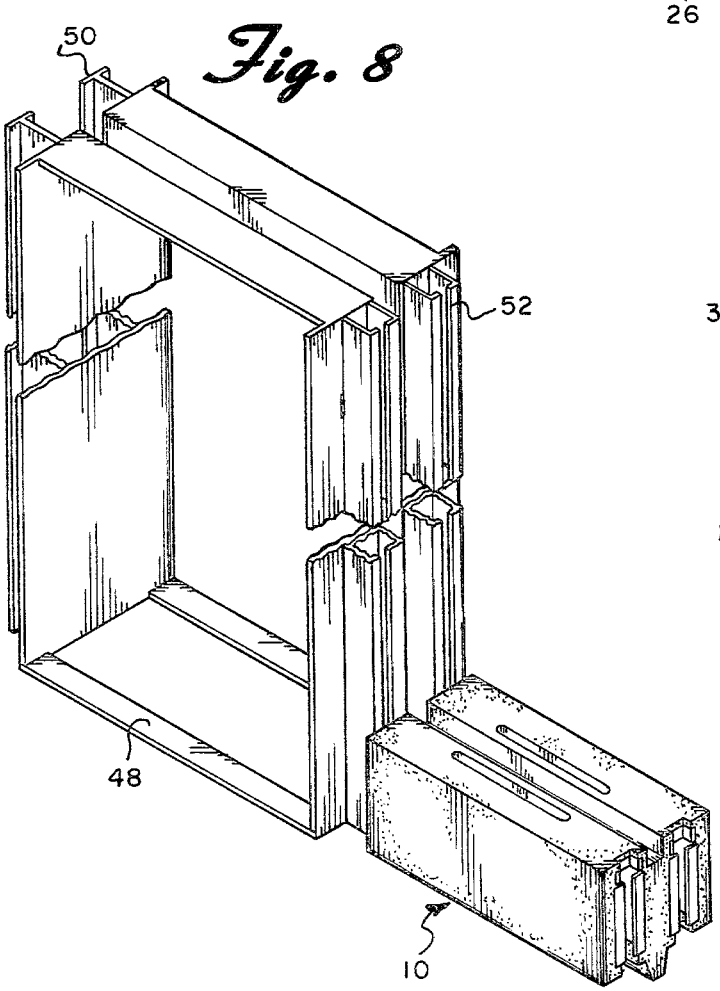

In order to build around doors and windows and the like, special frames may be provided. For example, a door frame is shown in FIG. 8. In addition to the conventional metal door frame 48, there are provided a pair of elongated T-shaped tongue members 50 and a pair of complementary groove members 52 on the opposite side of the frame 48. These tongues 50 and grooves 52 cooperate with the blocks in substantially the same manner that the tongues and grooves of the adjoining blocks cooperate with each other as described hereinabove.

The present invention may be embodied in other specific forms without departing from the spirit or essential attributes thereof and accordingly, reference should be made to the appended claims rather than to the foregoing specification as indicating the scope of the invention.

I claim:

1. An interlocking reinforced building block comprising:

a substantially rectangularly shaped block comprised essentially of cementitious material;

at least one metal reinforcing member embedded within said cementitious material, said reinforcing member extending substantially the entire height and the entire length of said block of cementitious material;

one end of said reinforcing member extending past one end of said block and terminating in an elongated, headed tongue of substantially T-cross section, said tongue extending substantially the entire height of said block, the other end of said reinforcing member terminating in an elongated groove of substantially rectangular cross section, said groove extending substantially the entire height of said block and including a slotted opening running substantially vertically adjacent the other end of said block, said groove having an opening at the top and bottom thereof, the opening at the top being smaller than the cross section of said groove and being only slightly larger than is needed to allow the tongue of a similarly constructed block to pass vertically through, and said tongue and groove being constructed so that the tongue of one block can be slid vertically into the groove of a similarly constructed block and wherein the two blocks may have limited longitudinal and pivotal movement with respect to each other while said tongue and groove are engaged.

2. The building block of claim 1 wherein the central portion of said reinforcing member has a plurality of holes therein so that the same may be securely held by said cementitious material.

3. The building block of claim 1 wherein there are pairs of said reinforcing members, tongues and grooves arranged in parallel with each other.

4. The building block of claim 1 further including an additional and differently constructed tongue and groove on the top and bottom of said block for maintaining a plurality of said blocks in vertical alignment.

* * * * *